US008370976B2

(12) United States Patent
Matt et al.

(10) Patent No.: US 8,370,976 B2
(45) **Date of Patent: *Feb. 12, 2013**

(54) FOLDING HEADREST MASSAGE APPARATUS

(76) Inventors: David J Matt, Long Beach, CA (US); Kevin Gard, Long Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/438,501

(22) Filed: Apr. 3, 2012

(65) Prior Publication Data

US 2012/0278993 A1 Nov. 8, 2012

Related U.S. Application Data

(63) Continuation-in-part of application No. 13/098,793, filed on May 2, 2011, now Pat. No. 8,176,587.

(51) Int. Cl.
*A47C 20/02* (2006.01)

(52) U.S. Cl. ..... 5/640; 5/638; 5/643; 5/661; 5/659

(58) Field of Classification Search ..... 5/661, 659, 5/658, 640, 643, 638, 636, 622
See application file for complete search history.

(56) References Cited

U.S. PATENT DOCUMENTS

| | | | | |
|---|---|---|---|---|
| 5,642,543 | A * | 7/1997 | Huntley | 5/640 |
| 6,148,460 | A * | 11/2000 | Fried et al. | 5/661 |
| 6,151,734 | A * | 11/2000 | Lawrie | 5/640 |
| 6,928,679 | B1 * | 8/2005 | Gross | 5/638 |
| 7,036,168 | B1 * | 5/2006 | Knickerbocker | 5/640 |
| 8,176,587 | B2 * | 5/2012 | Matt et al. | 5/640 |
| 2011/0296620 | A1 * | 12/2011 | Gard et al. | 5/661 |
| 2012/0073056 | A1 * | 3/2012 | Freund et al. | 5/639 |

* cited by examiner

*Primary Examiner* — Robert G Santos

(57) ABSTRACT

A folding headrest apparatus for massage consisting of an upper plate with a cushion attached thereto for the purpose of placing a massage receiver's head face-down. A rotatable mounted mechanism attached to an upper plate and an upwardly extending base portion for the purpose of rotating said upper plate generally 180-degrees. A lower plate portion for inserting between a mattress and box spring of a typical bed that meets said upwardly extending base portion at a generally 90-degree angle. A removable spacer element(s) sandwiched between the cushion and upper plate for the purpose of adjusting height of the cushion relative to a lower plate.

2 Claims, 6 Drawing Sheets

FOLDING HEADREST MASSAGE APPARATUS

FIELD OF THE INVENTION

The inventions described below relate to the field of massage table headrests, and, more particularly, to a massage table headrest that inserts between the mattress and box spring of a typical bed.

BACKGROUND OF THE INVENTION

It is common for people to lie down on a flat surface while receiving a massage. One such flat surface is a massage table specifically designed and intended for administering and receiving massages. It is typical that such tables include an outwardly extending headrest portion. Upon such headrest portion, the recipient places their head in order to create ease of breathing and improved alignment of spine, shoulders, neck and head. Various U.S. patents have been issued for inventions pertaining to the various embodiments of a massage table and headrest, many of which disclose massage tables assemblies that are expensive, heavy, and bulky.

Another such flat surface that people lay down on while receiving a massage is a typical bed. U.S. Pat. No. 6,148,460, entitled "Massage and Therapeutic Bed Extension Device", issued Mar. 2, 1999 to Fried, et al., describes a massage headrest device that inserts between a mattress and box spring of a typical bed. This invention assertedly provides improved back alignment for the massage recipient while laying on a bed, but undesirably requires multiple fasteners and a cross-member support brace, fails to embody a folding element for compact storage and transport convenience, fails to provide an expedient height-adjustment mechanism to accommodate varying mattress heights, fails to be engineered for lightweight construction, fails to be consumer-friendly, and is generally cumbersome and bulky.

U.S. Pat. No. 7,036,168, entitled "Portable Headrest", issued May 24, 2004 to Knickerbocker, describes another massage headrest device that inserts between a box spring and mattress of a typical bed. This invention assertedly provides means for folding the apparatus, means for adjusting the height of the apparatus, and improved back alignment for the massage recipient while laying on a bed, but undesirably requires simultaneous adjustment of two separately operated quick release clamps for parallel, even-balanced adjustment of height by way of a pair of telescoping upright elements, of which said telescoping upright elements are in abutment with the mattress. One embodiment of the cited reference appears to include a single telescoping upright element instead of two, though that is not expressly stated and no drawing is provided. Said embodiment includes the limitation of utilizing a quick release clamp for adjusting height of the telescoping upright element. Under said embodiment's configuration, the headrest portion is left to haphazardly rotate on a horizontal plane in addition to the intended vertical adjustment. Furthermore, when the cited reference utilizes one telescoping upright, the headrest portion cannot be horse-shoe shaped, as errantly disclosed in its claims, unless said telescoping upright is placed off-center to align with one of the end points of the horse-shoe shaped headrest, otherwise there is nothing for said telescoping upright to attach onto. Additionally, the device undesirably requires a two-step process of adjusting clamp and pin elements for locking and unlocking its bracing mechanisms along the lower base portion and upper plate portion when transitioning from a collapsed, folded state to a deployed, unfolded position, and vice-versa. Furthermore, as best understood, the scissor-like folding of the Knickerbocker apparatus leaves the headrest portion facing outward and exposed to the elements. In yet another embodiment of the cited reference, there are no cross members spanning the uprights or headrest portions of the device, resulting in extremely fragile construction that is susceptible to buckling, collapsing, or breaking. Furthermore, the Knickerbocker apparatus can only reasonably be made from plastic materials due to the nature and complexity of its numerous parts. This invention fails to provide a simple, easily deployable means for adjusting height, fails to be engineered for simple, sturdy construction, and fails to maintain operational design integrity throughout its numerous embodiments.

The invention described below is engineered without the use of mechanical telescoping uprights and/or quick-release clamps. It is engineered without the use of cross-member support braces. It is easily foldable, easily adjusted to accommodate varying mattress heights, can be manufactured from a wide assortment of materials, including wood, and requires no tools for assembly by the end-user.

What is needed is a foldable massage table headrest that overcomes the deficiencies in the prior art while containing fewer moving parts, is lightweight, easy to adjust for desired height, easily stored, and comparatively inexpensive to fabricate.

SUMMARY OF THE INVENTION

The invention described herein generally comprises a rotatably mounted mechanism enabling the apparatus to fold onto itself and into a compact state, providing convenient storage and transport capability. The invention may further comprise spacer elements sandwiched between an upper plate portion and headrest cushion, providing an expedient height-adjustment means.

The folding headrest of the invention is comprised of an upper plate portion with a headrest cushion attached thereto; a base element comprised of a lower plate portion and an upwardly extending base portion constructed from a singular continuous material; a rotatable mechanism that joins the upper plate portion to the upwardly extending base portion that allows the apparatus to fold over onto itself, beneficially resulting in the apparatus reducing its size in half.

The preferred embodiment is further comprised of a lower plate portion to be inserted between, for instance, a mattress and box-spring.

Accordingly, in a first aspect of the invention, a headrest apparatus is disclosed comprising an upper plate rotatably connected to an upwardly extending base portion, a base element comprised of a lower plate portion and an upwardly extending base portion constructed from a singular continuous material, whereby the lower plate portion outwardly depends from the upwardly extending base portion at about a 90 degree angle. A cushion element is provided that is affixed to the upper plate with a spacer element, or series of spacer elements, disposed between the upper plate and cushion element for raising the vertical height of the cushion relative to the lower plate.

In a second aspect of the invention, the upper plate is rotatably connected to the upwardly extending base portion by means of at least one hinge mechanism whereby the hinge mechanism containing an internal stopping agent restricting rotation of the upper plate to about 180 degrees.

The invention and its various embodiments can now be better understood by turning to the following description of the preferred embodiments which are presented as illustrated examples of the invention in any subsequent claims in any application claiming priority to this application. It is expressly understood that the invention as defined by such claims may be broader than the illustrated embodiments described below.

DETAILED DESCRIPTION OF THE INVENTION

Figure 1:
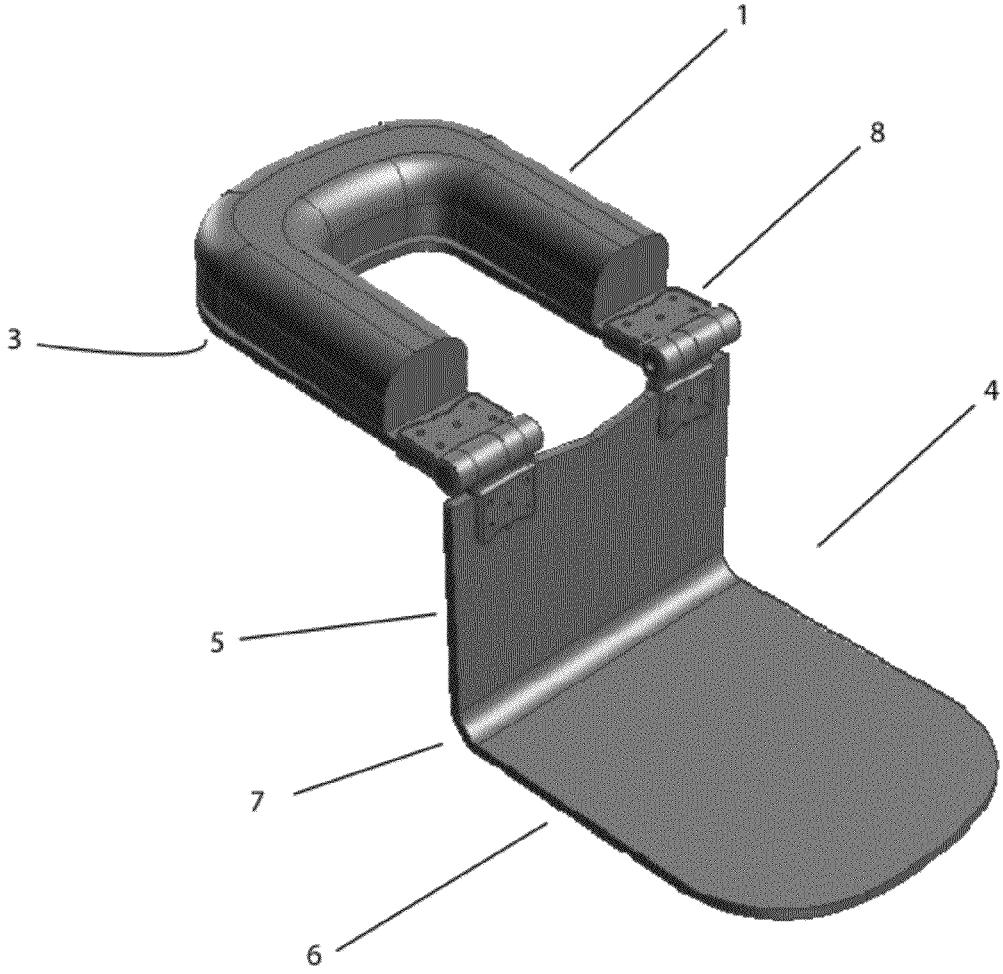
FIG. 1 is a side perspective view of the folding headrest massage apparatus in an unfolded state, shown without a height adjustment spacer.

Turning now to the figures wherein like references define like elements among the several views, FIG. 1 shows a side perspective view of the folding headrest of the invention used, for instance, for massage in an unfolded state. The apparatus may comprise a Cushion 1 for a massage receiver's head to rest upon. Cushion 1 is attached to an Upper Plate 3 in any number of ways such as by adhesive, hook and loop, screws, etc. Upper Plate 3 attaches to Upwardly Extending Base Portion 5 by way of Right and Left Hinges 8. Right and Left Hinges 8 are rotatably mounted mechanisms that permit Upper Plate 3 to rotate a generally 180 degrees from an outward unfolded position to a backward folded position.

FIG. 1 further shows Base 4 comprised of an Upwardly Extending Base Portion 5 and a Lower Plate 6 portion. Upwardly Extending Base Portion 5 meets Lower Plate 6 at a generally 90-degree angle at Meeting Point 7. Lower Plate 6 extends outwardly and away from Upwardly Extending Base Portion 5. Lower Plate 6 and Upwardly Extending Base Portion 5 of Base 4 are constructed from a singular continuous material at a generally 90 degree angle. As such, the apparatus is limited from including any rotation of the Upwardly Extending Base Portion 5 and is limited in including any ability to fold flat. In the unfolded state shown in FIG. 1, Lower Plate 6 inserts between, for instance, a mattress and box spring of a typical bed.

Figure 3:
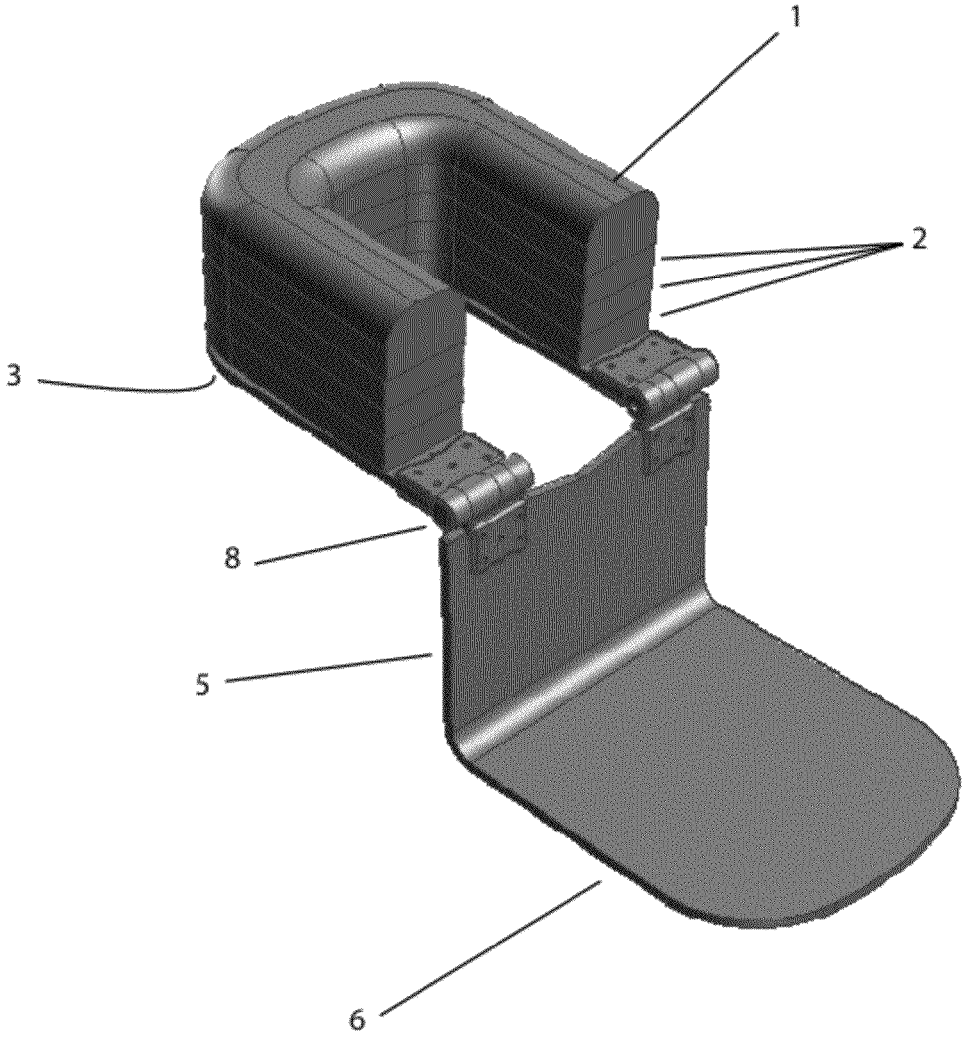
FIG. 3 is a side perspective view of the folding headrest massage apparatus in an unfolded state, shown with three height increasing spacers.

Referring now to a side perspective view of a preferred embodiment, as shown in FIG. 3, wherein the apparatus is deployed in an unfolded state and shown with three removable height increasing elements attached thereto, whereby a user can adjust the height of Cushion 1 depending on personal preference or mattress thickness. The apparatus may comprise any suitable height-increasing element sandwiched between Upper Plate 3 and Cushion 1, such as Spacer 2. In a preferred embodiment, the Spacer 2 element is comprised of a generally 1-inch thick, lightweight, dense foam material, though any suitable thickness and any suitable material known in the art can be used. A preferred shape of the Spacer 2 element is formed to match the silhouette of Upper Plate 3, though any number of shapes can be used. The Spacer 2 element rests atop Upper Plate 3, and is removeably attached thereon in any number of ways such as by adhesive, hook and loop, snaps, etc. The Spacer 2 element rests beneath Cushion 1, and is removeably attached thereto in any number of ways such as by adhesive, hook and loop, snaps, etc. As such, the Spacer 2 element is attached to and sandwiched between Cushion 1 and Upper Plate 3 for the purpose of increasing the height of Cushion 1 relative to Lower Plate 6. The Spacer 2 element is used for raising the height of Cushion 1 in order for Cushion 1 to be positioned at the same height as the surface of a mattress, thereby properly aligning the massage receiver's head with the rest of their body as they lay on top of the mattress.

Again referring to FIG. 3, any number of Spacer 2 elements may be layered atop each other to further raise, or build up, the height of Cushion 1. FIG. 3 shows the apparatus with three Spacer 2 elements stacked one atop the other and sandwiched between Upper Plate 3 and Cushion 1. When more than one Spacer 2 elements are in use, they removeably attach to each other in any number of ways such as by adhesive, hook and loop, snaps, etc.

Figure 2:
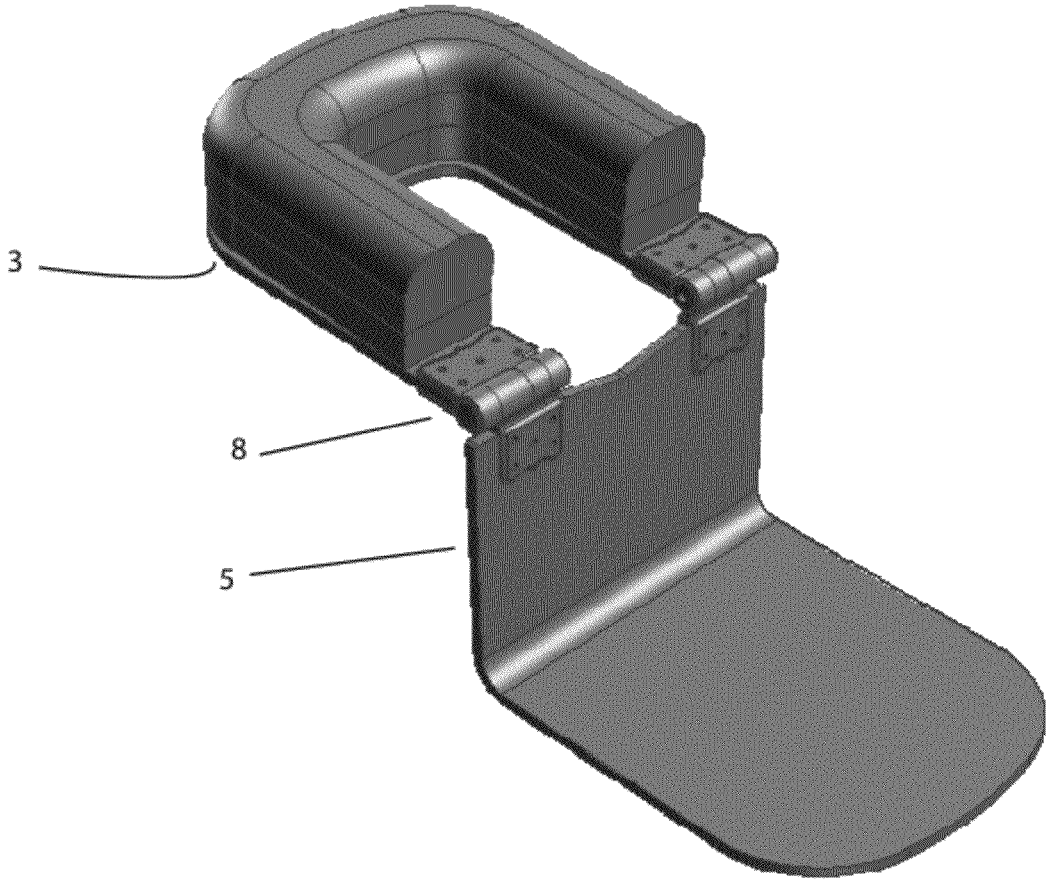
FIG. 2 is a side perspective view of the folding headrest massage apparatus in an unfolded state, shown with one height increasing spacers.

As shown in FIGS. 1-3, means for bracing an Upper Plate 3 in the unfolded position may include any suitable bracing means, such as Right and Left Hinges 8. Turning now to a preferred embodiment of Right and Left Hinges 8 shown in FIGS. 5*a-e*, Right and Left Hinges 8 is comprised of an Upper Plate Hinge Flange 9 portion, a Base Hinge Flange 10 portion, a Hinge Core 11 portion, and a Hinge Cap 12 portion. A common fastener, such as a screw or bolt, inserts through Hinge Cap 12 and further into Hinge Core 11 for the purpose of attaching said Hinge Cap 12 to the assembled hinge mechanism. Right and Left Hinges 8 contain an internal stopping agent that restricts rotation of Upper Plate 3 to about 180 degrees. The internal stopping agent does not provide for varying degrees of adjustment; it provides for a singular generally 180-degree rotation only. Furthermore, Right and Left Hinges 8 requires no unlocking or locking procedure for it to be utilized. Referring briefly to FIGS. 1-3, Right and Left Hinges 8 are attached to Upper Plate 3 and Upwardly Extending Base Portion 5 by way of any suitable fasteners such as screws, rivets, etc.

Figure 4:
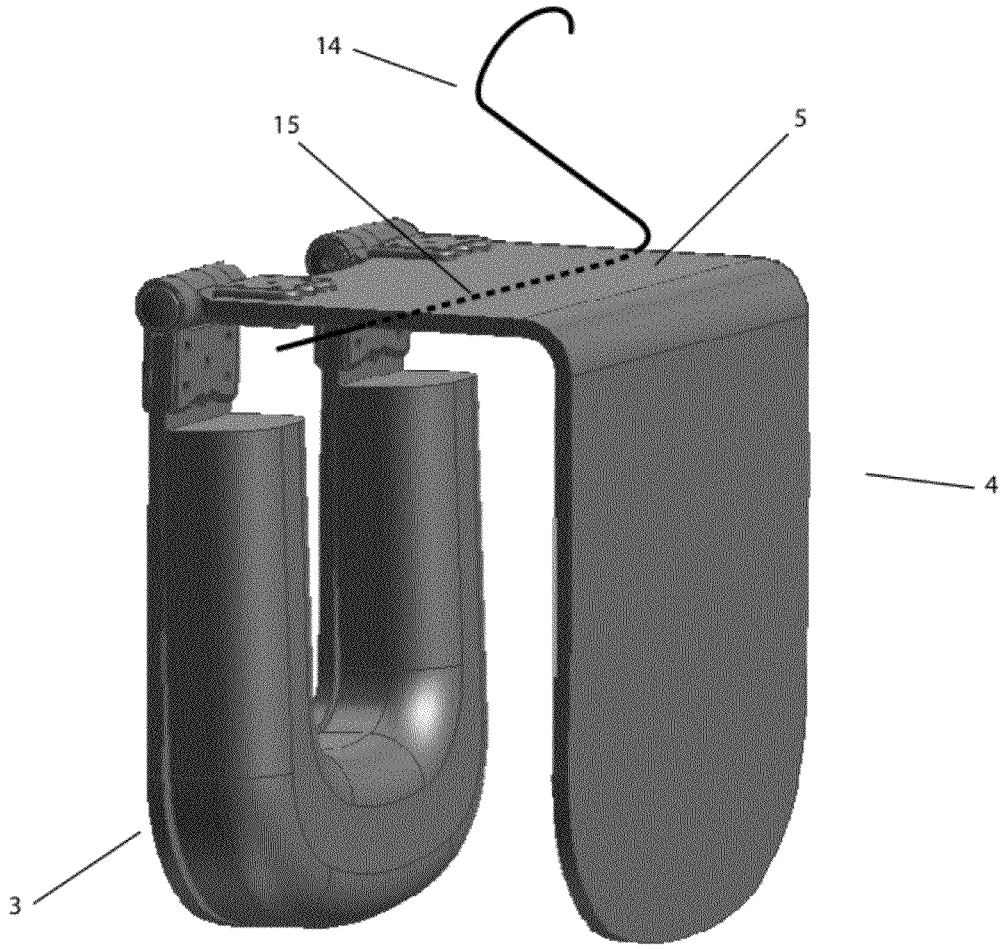
FIG. 4 is a side perspective view of the apparatus of FIG. 1, showing the apparatus folded over onto itself.
Figure 5A:
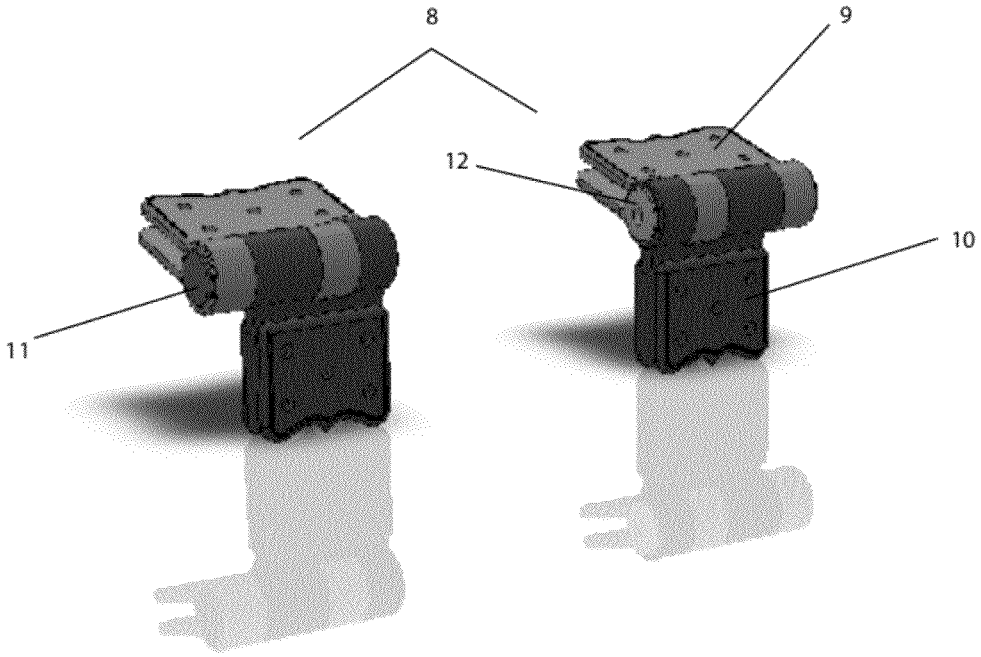
FIG. 5*a* is a forward perspective view of the right and left hinge assembly used to connect the upper plate portion and upward extending base portion of FIG. 1, shown without any other parts.
Figure 5B:
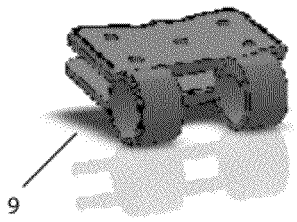
FIGS. 5*b-e* illustrate the individual elements of FIG. 5*a*, shown without any other parts.
Figure 5C:
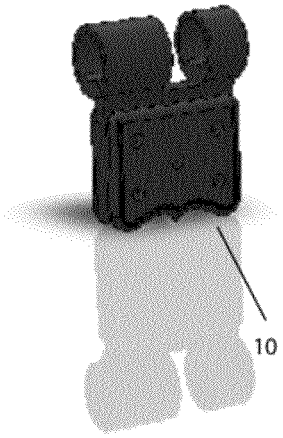
Figure 5D:
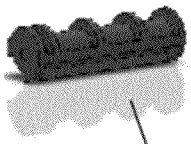
Figure 5E:
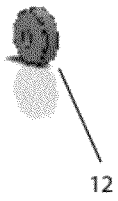

FIG. 4 shows Upper Plate 3 folded backward on top of itself. When folded backward on top of itself, the apparatus is reduced in length by about 50%, providing for storage and transport convenience. In either the unfolded position, as shown in FIGS. 1-3, or the folded position, as shown in FIG. 4, Upper Plate 3 extends away from Upwardly Extending Base Portion 5 at about a 90-degree angle.

Figure 6:
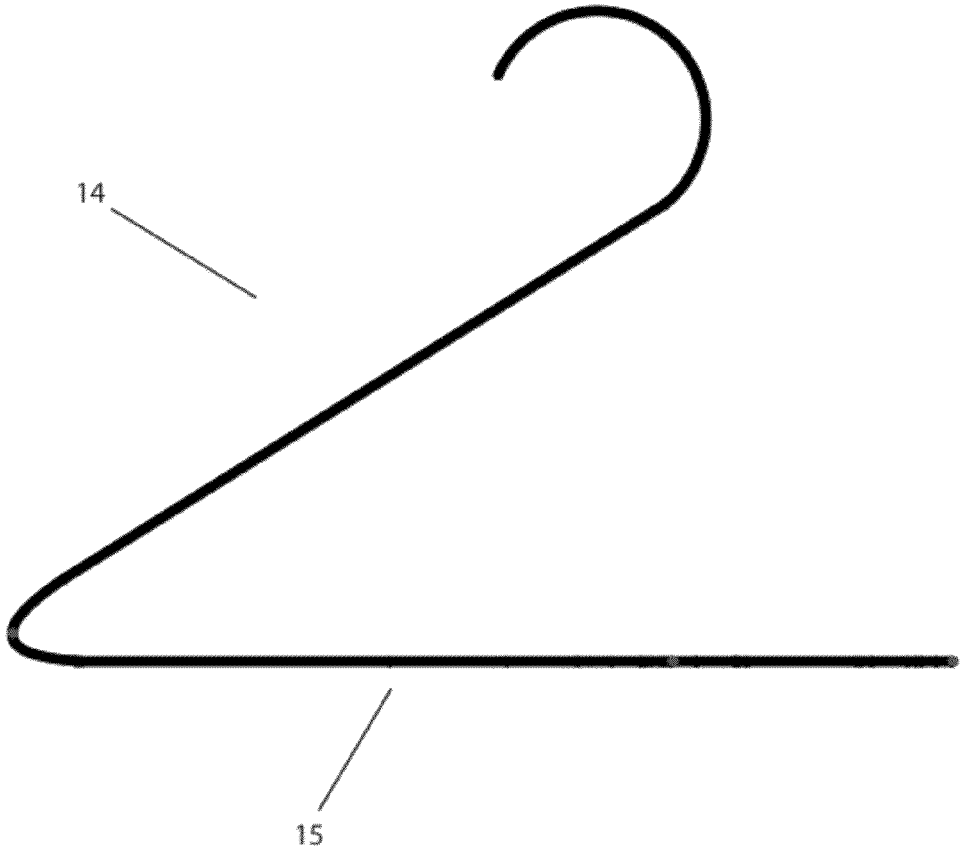
FIG. 6 is a side perspective view of the hanger element.

As shown in FIG. 6, a Hanger 14 element is fashioned in an unenclosed shape from any suitable material, such as metal, so as to leave one side open. Hanger 14 further includes a Lower Bar Portion 15. As shown in FIG. 4, Hanger 14 supports the folding headrest massage apparatus as a result of Lower Bar Portion 15 extending across the underside of Upward Extending Base Portion 5 of Base 4. Hanger 14 is shaped as such to be able to balance the apparatus on Lower Bar Portion 15 while hanging on a rail. A groove may be fashioned within the underside of Upward Extending Base Portion 5 to serve as a nesting bay for Lower Bar Portion 15.

The invention described below may be fabricated from any suitable material, but the preferred embodiment is fabricated from a lightweight, high-strength material such as wood or plastic.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by any claims in any subsequent application claiming priority to this application.

For example, notwithstanding the fact that the elements of such a claim may be set forth in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a subsequent claim must be understood as being generic to all possible meanings supported by the specification and by the word itself.

The definitions of the words or elements of any claims in any subsequent application claiming priority to this application should be, therefore, defined to include not only the combination of elements which are literally set forth, but all equivalent structure, material or acts for performing substantially the same function in substantially the same way to obtain substantially the same result. In this sense, it is therefore contemplated that an equivalent substitution of two or more elements may be made for any one of the elements in such claims below or that a single element may be substituted for two or more elements in such a claim.

Although elements may be described above as acting in certain combinations and even subsequently claimed as such, it is to be expressly understood that one or more elements from a claimed combination can in some cases be excised from the combination and that such claimed combination may be directed to a subcombination or variation of a subcombination.

Insubstantial changes from any subsequently claimed subject matter as viewed by a person with ordinary skill in the art, now known or later devised, are expressly contemplated as being equivalently within the scope of such claims. Therefore, obvious substitutions now or later known to one with ordinary skill in the art are defined to be within the scope of the defined elements.

Any claims in any subsequent application claiming priority to this application are thus to be understood to include what is specifically illustrated and described above, what is conceptually equivalent, what can be obviously substituted and also what essentially incorporates the essential idea of the invention.

We claim:

1. A headrest apparatus comprising:

an upper plate rotatably connected to an upwardly extending base portion;

a base element comprised of a lower plate portion and the upwardly extending base portion constructed from a singular continuous material, whereby the lower plate portion outwardly depends from the upwardly extending base portion at about a 90 degree angle;

a cushion element affixed to the upper plate;

a spacer element, or series of spacer elements, disposed between the upper plate and cushion element for raising the vertical height of the cushion element relative to the lower plate.

2. The device of claim 1 wherein the upper plate is rotatably connected to the upwardly extending base portion by means of at least one hinge mechanism;

at least one hinge mechanism containing an internal stopping agent restricting rotation of the upper plate to about 180 degrees.

* * * * *